US009345335B2

(12) United States Patent
Giori et al.

(10) Patent No.: US 9,345,335 B2
(45) Date of Patent: May 24, 2016

(54) PRESSURE CONTROL AND FEEDBACK SYSTEM FOR AN ADJUSTABLE FOAM SUPPORT APPARATUS

(76) Inventors: Gualtiero G. Giori, Fort Myers, FL (US); Janine Giori, Fort Myers, FL (US)

( * ) Notice: Subject to any disclaimer, the term of this patent is extended or adjusted under 35 U.S.C. 154(b) by 836 days.

(21) Appl. No.: 13/200,841

(22) Filed: Oct. 3, 2011

(65) Prior Publication Data

US 2012/0090698 A1 Apr. 19, 2012

Related U.S. Application Data

(63) Continuation-in-part of application No. 12/924,421, filed on Sep. 27, 2010, now abandoned.

(51) Int. Cl.
*A47C 27/08* (2006.01)
*A47C 27/18* (2006.01)

(52) U.S. Cl.
CPC ..... *A47C 27/088* (2013.01); *A47C 27/083* (2013.01); *A47C 27/18* (2013.01); *Y10T 137/36* (2015.04)

(58) Field of Classification Search
CPC .... A47C 27/082; A47C 27/10; A47C 27/083; A47C 27/088; A47C 27/18
USPC ..... 5/713, 615, 715, 709
See application file for complete search history.

(56) References Cited

U.S. PATENT DOCUMENTS 2,819,712 A * 1/1958 Morrison ..... 601/148
4,951,335 A * 8/1990 Eady ..... 5/709
5,020,176 A * 6/1991 Dotson ..... 5/710
5,170,364 A * 12/1992 Gross et al. ..... 702/139
5,566,409 A * 10/1996 Klearman ..... 5/723
5,592,706 A * 1/1997 Pearce ..... 5/654
5,729,853 A * 3/1998 Thompson ..... 5/713
5,765,246 A 6/1998 Shoenhair ..... 5/680
5,848,450 A 12/1998 Oexman et al. ..... 5/713
6,014,784 A 1/2000 Taylor et al. ..... 5/713
6,037,723 A 3/2000 Shafer et al. ..... 318/6
6,056,008 A * 5/2000 Adams et al. ..... 137/487.5
6,058,537 A 5/2000 Larson ..... 5/710
6,106,449 A * 8/2000 Wynne ..... 493/101
6,202,239 B1 * 3/2001 Ward et al. ..... 5/727
6,206,654 B1 * 3/2001 Cassidy ..... 417/312
6,253,401 B1 7/2001 Boyd ..... 5/713
6,367,106 B1 * 4/2002 Gronsman ..... 5/709
6,378,152 B1 * 4/2002 Washburn et al. ..... 5/713
6,396,224 B1 * 5/2002 Luff et al. ..... 318/16
6,397,419 B1 6/2002 Mechache ..... 5/722
6,483,264 B1 * 11/2002 Shafer et al. ..... 318/16

(Continued)

*Primary Examiner* — David E Sosnowski
*Assistant Examiner* — Eric Kurilla
(74) *Attorney, Agent, or Firm* — William E. Noonan

(57) ABSTRACT

A pressure control and feedback system for an adjustable foam support includes a vacuum pump for drawing air from a hermetically sealed foam core to reduce the firmness of the core. A valve opens to permit and closes to block the passage of air into and out of the core. A remotely operated controller generates control signals to selectively start and stop operation of the pump, and selectively open and close the valve, which provides a selected level of pneumatic pressure and corresponding firmness in the core. A pressure sensor detects the pressure and firmness of the core and generates representative feedback signals. An indicator device responsive to the feedback signals indicates the sensed firmness of the core. Software calibrates the system and provides the system with intelligent operation.

23 Claims, 9 Drawing Sheets

(56) References Cited

U.S. PATENT DOCUMENTS

| | | | | |
|---|---|---|---|---|
| 6,684,433 | B2 * | 2/2004 | Giori et al. | 5/709 |
| 6,686,711 | B2 * | 2/2004 | Rose et al. | 318/16 |
| 6,990,700 | B2 * | 1/2006 | Chung | 5/713 |
| 7,107,642 | B2 | 9/2006 | Wong et al. | 5/713 |
| 7,171,711 | B2 * | 2/2007 | Gowda | 5/713 |
| 7,427,109 | B2 * | 9/2008 | Embach et al. | 297/452.41 |
| 7,480,952 | B2 | 1/2009 | Nickerson et al. | 5/655.3 |
| 7,784,131 | B2 * | 8/2010 | Genaro et al. | 5/713 |
| 8,424,967 | B2 * | 4/2013 | Kilincsoy et al. | 297/284.3 |
| 2004/0003471 | A1 * | 1/2004 | VanSteenburg | 5/709 |
| 2005/0005363 | A1 | 1/2005 | Giori et al. | 5/709 |
| 2005/0155154 | A1 * | 7/2005 | Kasatshko et al. | 5/713 |
| 2006/0075569 | A1 * | 4/2006 | Giori et al. | 5/709 |
| 2006/0162074 | A1 * | 7/2006 | Bader | 5/421 |
| 2007/0094806 | A1 | 5/2007 | Beretta | 5/713 |
| 2008/0000029 | A1 * | 1/2008 | Feingold et al. | 5/690 |
| 2008/0000030 | A1 * | 1/2008 | Wang | 5/713 |
| 2008/0229508 | A1 * | 9/2008 | Chaffee | 5/706 |
| 2008/0256717 | A1 * | 10/2008 | Austen et al. | 5/709 |
| 2008/0300578 | A1 * | 12/2008 | Freedman | 604/543 |
| 2009/0000037 | A1 * | 1/2009 | Graebe, Jr. | 5/654 |
| 2009/0064416 | A1 * | 3/2009 | Kummer et al. | 5/709 |
| 2009/0144909 | A1 | 6/2009 | Skinner et al. | 5/713 |
| 2010/0064443 | A1 * | 3/2010 | Lee | 5/713 |
| 2011/0225739 | A1 * | 9/2011 | Hanrahan | 5/709 |
| 2012/0011657 | A1 * | 1/2012 | Kovacs et al. | 5/709 |
| 2012/0304391 | A1 * | 12/2012 | Driscoll et al. | 5/710 |

* cited by examiner

PRESSURE CONTROL AND FEEDBACK SYSTEM FOR AN ADJUSTABLE FOAM SUPPORT APPARATUS

RELATED APPLICATION

This application is a continuation in part and claims the benefit of U.S. patent application Ser. No. 12/924,421 filed Sep. 27, 2010 now abandoned.

FIELD OF THE INVENTION

This invention relates to a system for controlling and providing feedback of the pressure, firmness, contour and support of an adjustable foam support apparatus.

BACKGROUND OF THE INVENTION

I have recently introduced adjustable foam mattresses and supports wherein a vacuum pump is employed to adjust the level of vacuum pressure in a foam core so that a desired density and firmness/softness is achieved. Generally, as air is removed, the foam core becomes softer and more contoured whereas allowing the core to partially or fully self-inflate on its own increases the firmness of the support. Achieving a precise, custom level of firmness, softness or contour for the individual user has been impossible since currently sold foam beds come factory preset at a density and IFD value that cannot be modified by the user. Individual users tend to vary widely in size, shape and body type. As a result, there are an almost endless variety of optimal corresponding softness, firmness and contour levels that may be set for the support. The forgoing situation is complicated when the user engages his or her body on the foam support. The weight and shape of the user's body is apt to further affect the internal pressure and resulting firmness of the core. To date, conventional devices have not allowed the user to easily and precisely achieve an optimal and customizable level of comfort and support.

SUMMARY OF THE INVENTION

It is therefore an object of the present invention to provide a system for more effectively and accurately achieving a custom level of comfort and support in a mattress containing one or more hermetically sealed airtight foam cores.

It is a further object of this invention to provide a system that provides immediate and effective feedback regarding the firmness, softness, contour and optimal support of an adjustable foam mattress and that utilizes such feedback to permit quick and convenient adjustment for the support to meet the custom comfort levels desired by the user.

It is a further object of this invention to provide a pressure adjustment and feedback system for an adjustable foam support that utilizes a convenient, ergonomic and easy to use remote control apparatus for allowing the user to quickly, reliably and precisely adjust the comfort and support level of an adjustable foam support by either keypad controls or voice activated commands.

It is a further object of this invention to provide a vacuum pressure control capable of drawing air from a foam core and creating a vacuum to reduce the firmness and increase the softness of the foam core, and further capable of adding air within the foam core to ensure the foam core returns to a maximum firm state of atmospheric pressure.

This invention features a vacuum pressure control and feedback system for a support apparatus having a hermetically sealed foam core, which core has incrementally adjustable levels of firmness, softness and contour. The system includes a vacuum pump unit in pneumatic communication with the foam core for drawing air from the foam core and creating a vacuum, to reduce the firmness and increase the softness of the foam core. By deactivating the pump, the system is capable of adding air within the foam core to ensure the foam core returns to a maximum firm state of atmospheric pressure.

At least one valve is in pneumatic communication with the core for alternately opening and closing to permit and block passage of air into and out of the core respectively. A respective valve may be provided for each side of the support. A controller generates selected control signals for operating the pump and the one or more valve. Each control signal is representative of a respective one of multiple firmness levels of the core. The control signals selectively start and stop operation of the pump and selectively open and close the one or more valves to provide a selected level of pneumatic pressure (typically negative or vacuum pressure) and corresponding firmness/softness (referred to collectively herein as "firmness") in the foam core. One or more pressure sensors in pneumatic communication with the core sense the pneumatic pressure and corresponding firmness of the core and generate feedback signals indicative thereof. A CPU and associated software are in electronic communication with the pressure sensor and respond to the feedback signals for controlling operation of the pump, valves and other components (e.g. night light) associated with the support system.

In a preferred embodiment, the controller selectively generates and transmits a minimum control signal representative of a minimum pneumatic pressure and corresponding firmness in the core, a maximum control signal representative of a maximum pneumatic pressure and corresponding firmness in the core and at least one intermediate control signal representative of a pneumatic pressure intermediate said minimum and maximum pneumatic pressures and a firmness intermediate said minimum and maximum firmnesses. The controller may include one or more remote control units for generating the selected control signals and a recharger/base control unit responsive to the remote control unit for operating the pump and the valve in accordance with the selected control signals. The indicator device may be carried by the remote control unit. The remote control unit and the indicator device may be integrated into a transceiver unit having a transmitter for directing the control signals to the base control unit and a receiver for directing the feedback signals from the pressure sensor to the indicator device. The control signals may be directed from the transmitter to the base control unit and the feedback signals may be transmitted from the pressure sensor, CPU and software to the receiver by means of RF signals. The transceiver unit may include a rechargeable DC battery and be mountable on a DC recharging station for recharging the battery.

The indicator device may provide a visual display and/or an audio report of the sensed firmness. The indicator device may include means for indicating a change in the vacuum pressure sensed in the core independent of operation of the pump and valve.

The controller may be programmable for providing selected control signals that operate the pump and the valve to produce respective levels of firmness in the core. The remote control unit may include at least one of a touch pad and a touch screen for generating a selected control signal. The remote control unit may include voice responsive means for generating selected control signals.

Means responsive to the pressure sensor may be provided for calibrating a custom firmness level of the core for a particular user in response to the pressure sensor detecting a change in vacuum pressure in the core as a result of the user being supported upon the core while the pump is stopped and the valve is closed. The remote control unit may include means for generating a selected control signal that causes the pump and the valve to operate to produce the custom optimum support level of the core. The controller may be responsive to the feedback signals for indicating that the sensed pressure of the core differs from the selected pressure. This instructs the user to operate the remote control unit to generate an adjustive control signal that, in turn, operates the valve and the pump to provide the core with the selected pressure level.

The vacuum pump unit may be communicably joined to the foam core by one or two hoses. Dual hoses are used for respective side chambers of the support/core. A pressure sensing tube may extend interiorly through each hose and be interconnected between the interior of the support apparatus and a respective pressure sensor. This permits the actual vacuum pressure within the foam core to be measured directly and dynamically in real time.

A dual valve mechanism may be engaged with the pair of the vacuum hoses for enabling the pump to draw air from the foam core through a selected one of the hoses and thus from a selected side of the foam support. This mechanism may include a pair of piston valves. Each valve is spring biased into a normally closed state to block communication between the vacuum pump and a respective hose. Each piston valve may be connected to a respective side of a pivoting actuator member. The actuator member may be pivotally driven by a motor, mini motor or similar device controlled by the CPU. The motor responds to programmed signals from the CPU to selectively pivot the actuator member into a first position, which opens a first one of the valves while maintaining the other second valve in a closed state, and into an opposite second position, which opens the second valve while maintaining the first valve in a closed sate. The vacuum in a selected side of the support is then adjusted, as needed, through a respective hose connected to the selected side of the core. When no vacuum adjustment is required, the CPU directs a corresponding signal to the motor, which positions the actuator member such that both piston valves are spring biased into a closed state.

DETAILED DESCRIPTION OF PREFERRED EMBODIMENTS

Other objects, features and advantages will occur from the following description of a preferred embodiment and the accompanying drawings, in which.

Figure 1:
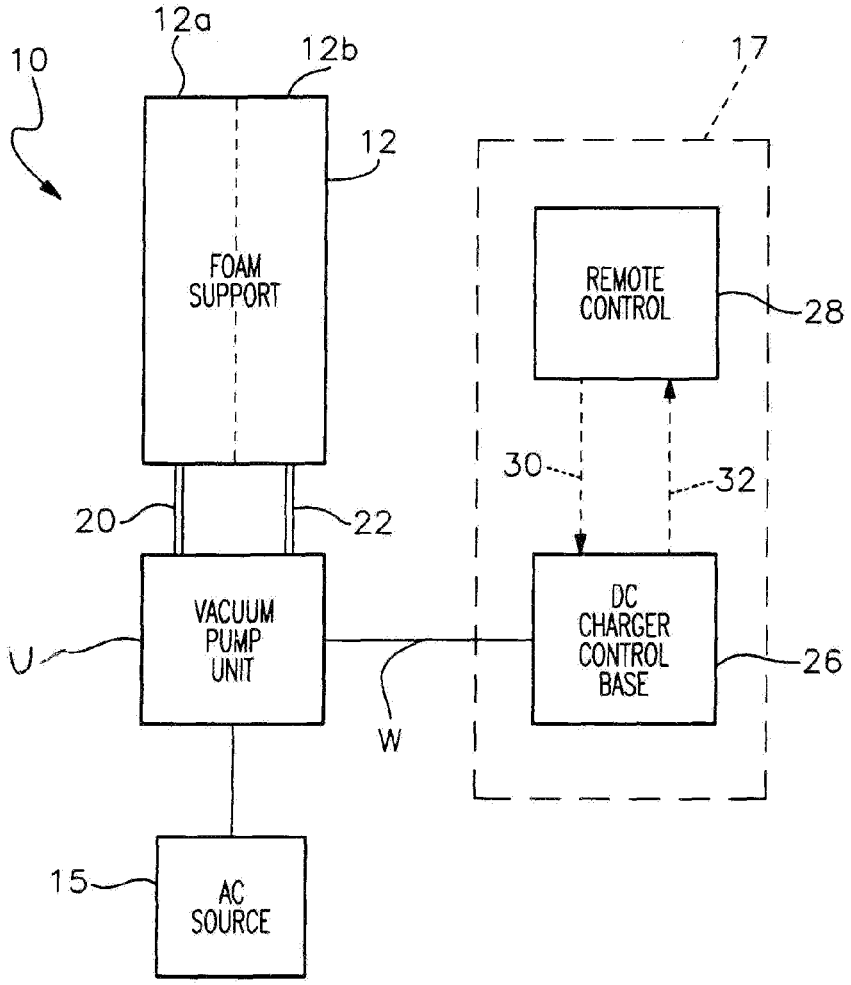
FIG. 1 is a schematic view of a preferred pressure control and feedback system according to this invention.

There is shown in FIG. 1 a pressure control and feedback system 10 for an adjustable foam support apparatus 12. Various supports of this type are disclosed in U.S. Pat. Nos. 6,684,433, 6,745,420 and 6,922,863, the disclosures of which are incorporated herein by reference. In particular, adjustable support 12 comprises a hermetically sealed, self-inflating foam core that has incrementally adjustable levels of firmness and softness. Such supports may be used for a wide variety products including, but not necessarily limited to mattresses, toppers, mats, pads, seat covers, recliners, automobile seats, etc. The particular application for the adjustable foam support apparatus is not a limitation of this invention.

Apparatus 12 is incrementally adjusted for density and firmness by removing selected amounts of air from the foam core through the hermetically sealed covering. In particular, a vacuum pump unit U is communicably and operatively interconnected to the foam core of apparatus 12. In the version described herein, vacuum pump unit U is communicably interconnected by air transmitting conduits 20 and 22, respectively to discrete, hermetically seated chambers formed in respective sides 12*a* and 12*b* of foam support 12. The conduits are peripherally sealed at their respective points of attachment with the cover of the foam support, in a manner which will be known to those skilled in the art and illustrated, for example, in the patents cited above. A particularly preferred conduit comprising a hose having an integral pressure transmitting tube formed therethrough is described below in connection with FIG. 6.

Vacuum pump unit U (shown also in FIG. 2) is powered by an AC source 15 (e.g. 110 volts). The pump unit is controlled by a pump control system 17 to selectively introduce air into and remove air from respective sides 12*a* and 12*b* of support 12. This system (further shown in FIG. 3) includes a base control 26 that is connected to pump unit U by wiring W. Base control 26 also comprises a recharger as described below. The control system further includes a remote control unit 28 that delivers control signals 30 to base 26 and receives feedback signals 32 from the base in a manner that is described more fully below. Control system 17 operates vacuum pump unit U such that one or both sides of support 12 are provided with a desired level of air pressure (more particularly negative or vacuum pressure) in order to achieve a corresponding level of contour and support.

Figure 2:
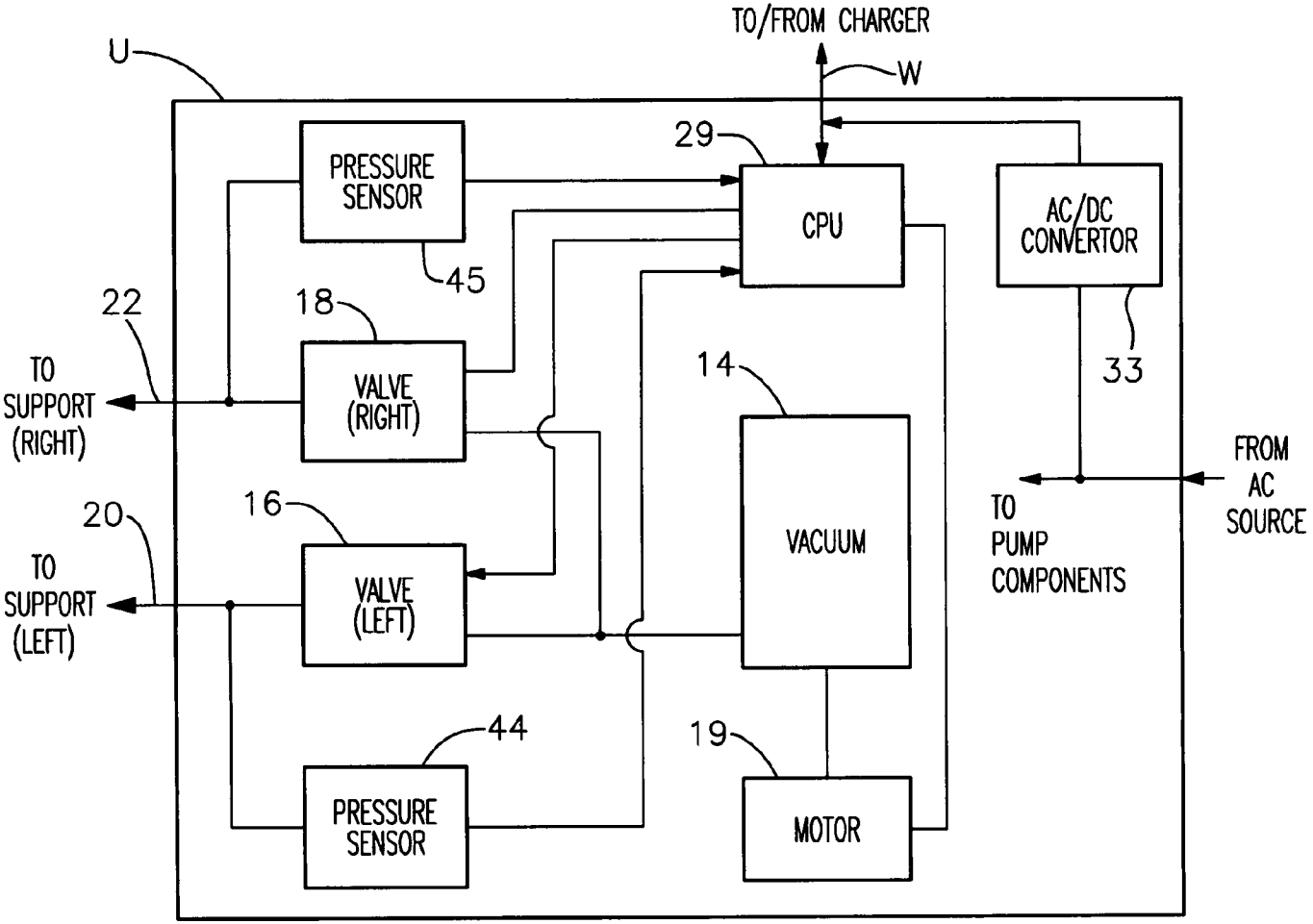
FIG. 2 is a schematic view of the pump unit.

As shown more particularly in FIG. 2, pump unit U features a vacuum pump 14 driven by a motor 19. Vacuum pump 14 is connected to a left-hand side of the foam support through a first valve 16. The vacuum is similarly connected communicably to the right hand side of the foam support through a second valve 18. As best shown in FIGS. 1 and 2, conduits 20, 22 are joined to respective ports 23, 25 (FIG. 4) formed in the housing H of pump unit U. AC power is provided to unit U to activate the internal components of the pump unit. Appropriate circuitry, which will be known to persons skilled in the art, is utilized to power the various components within the pump unit.

Referring to FIG. 2, air is removed from a selected side of the foam core by operating vacuum pump 14 and opening a respective one of valves 16 and 18. When a desired level of air pressure (more particularly by varying the negative or vacuum pressure) and corresponding support are achieved, the pump is turned off and the valve is closed to maintain a corresponding side of support 12 in a selected condition of pressure and support. The core may be further deflated and thereby softened by repeating this process. Alternatively, a selected side of the core may be inflated and made firmer by opening a respective one of the valves 16, 18 while vacuum pump 14 is not running. This allows the corresponding side of the foam core to self inflate at a controlled speed. When desired levels of pressure and corresponding firmness are achieved, the valve is again closed to maintain that level of support. The system of this invention may use various types of known pumps and valves such as those described in the foregoing references. In alternative embodiments, the valves 16, 18 may be formed in integrally with pump 14. A preferred dual valve structure is described below in connection with FIG. 7.

Figure 3:
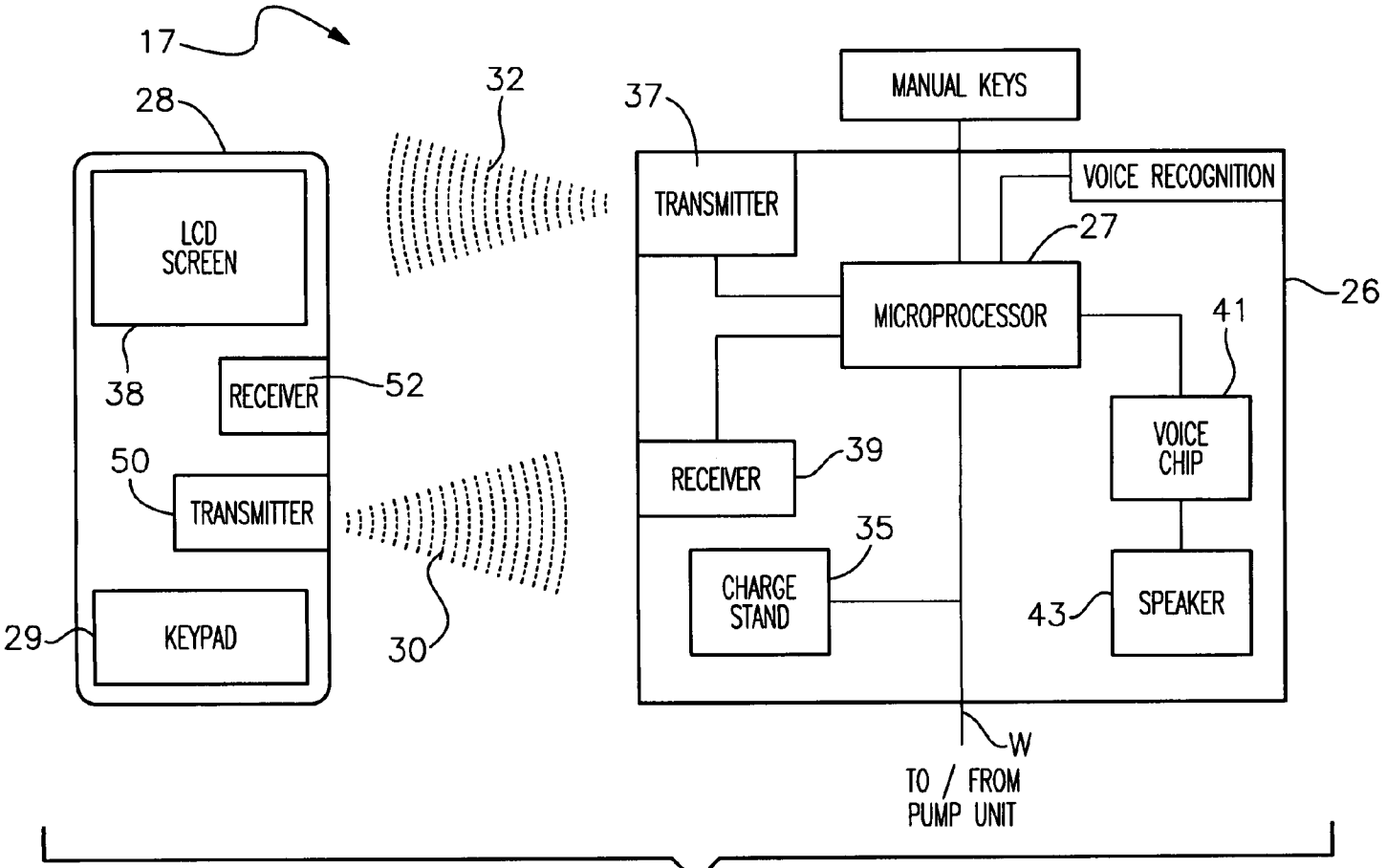
FIG. 3 is a schematic view of the control system including the charger/base control and the remote control.

Operation of pump 14 and valves 16, 18 in the foregoing manner is controlled by control system 17. As shown in FIGS. 2 and 3, base control 26 is operably connected to pump unit U by wiring W. In particular, a programmable microprocessor 27 of base control 26 is connected to a CPU 29 of pump unit U. Microprocessor 27 is programmed to direct control signals to the pump unit so that the vacuum pump is operated to inflate or deflate the foam core in a desired manner. The base control, which is DC powered, also serves to hold and recharge remote control unit 28. In particular, as shown in FIG. 2, an AC/DC converter provides DC power to base 26. Remote control 28 is thereby recharged (in the manner shown in FIG. 4) when it is operably engaged with a conventional charge stand 35 in recharger/base control 26.

As shown in FIG. 3, base control unit 26 comprises an RF transceiver unit including a transmitter 37 and a receiver 39. These components are operably connected to microprocessor 27, which may comprise various known types of microprocessors. The manner of interconnecting and assembling these components will be understood to persons skilled in the art. Base control 26 also includes a voice chip 41 that is operated by microprocessor 27. The voice chip provides audible signals to a speaker 43 that in turn provides the user with audible indications of various firmness and contour levels exhibited by the support.

Remote control unit 28 communicates with base control 26 by means of reciprocal RF signals 30 and 32. The remote control unit, which is shown mounted in a recharging cradle 35 of unit 26 in FIG. 4, includes a keypad 2 for directing RF control signals 32 to base controller 26 and thereby operating the pump and valve to adjust the foam support level. Remote control unit 28 also includes a visual LCD display 38 and the remote control unit may include an optional audible indicator and voice activated controller as will be described more fully below. The remote control unit 28 includes a transceiver featuring a transmitter 50, FIG. 3, for sending control signals 32 to base 26 and a receiver 52 for receiving feedback signals 30 from the base control. The transceiver is powered by a rechargeable DC battery that is recharged by DC recharger unit 35 in base unit 26.

In another embodiment, the remote control unit may be wired directly to the pump unit. This is particularly useful in a busy showroom accommodating many similar mattresses where wireless communication may suffer in such a crowded space.

Controller 27 features software that is programmed to allow the user to direct the pump and valve to provide predetermined levels of firmness/softness, contour and pressure within support apparatus 12. Preprogrammed levels may be provided. Alternatively, selected custom levels may be programmed into the base controller through the remote control unit. Programmed levels may correspond to the user's custom levels for soft, medium and firm pressure and support. Various alternative support levels and numbers of levels may be programmed into the base in accordance with this invention. For example, the user may be allowed to program various different support levels reflecting respective degrees of firmness or contour. "Contour" refers to the degree to which the mattress conforms to the user's particular body shape. An increased contour level provides greater conformance (wherein the foam is softer) whereas a lesser contour level provides less bodily conformance or none at all. The program levels, are predetermined to provide corresponding levels of contour or alternatively corresponding levels of firmness or softness for particular users' weights and body types. Once again, various incremental levels of firmness/softness, contour and pressure may be programmed into the base controller 26.

Figure 4:
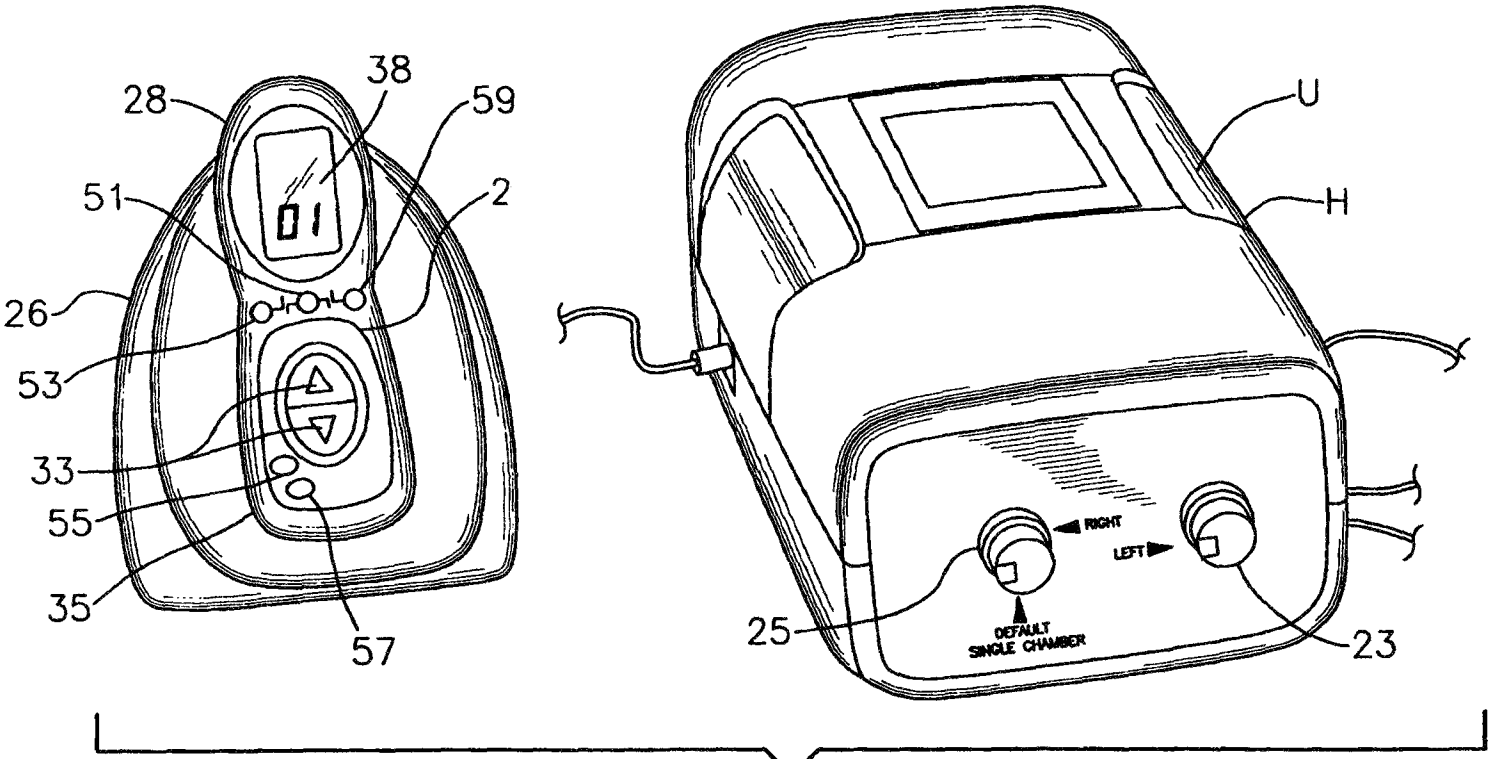
FIG. 4 is a perspective view of the three principle components (pump unit, base control/recharger and remote control) of the system.

As shown in FIG. 4, keypad 2 of remote controller 28 includes keypad buttons 33 that allow the user to remotely select a pre-programmed level of firmness, pressure or contour by scrolling through available levels. The remote controller 28 communicates with base controller 26 (FIG. 1) by sending conventional RF control signals 30 that respectively reflect the particular custom setting that the user desires to select. The user utilizes remote controller 28 to select the desired firmness/contour/pressure level by accessing appropriate keys on keypad 2. When a particular condition to be set is accessed, it appears on visual screen 38. The user may then scroll through various pre-programmed levels using "up" and "down" buttons 33.

Pre-programmed levels may be selected, set and viewed in a manner analogous to that used in conventional remote control devices used in a variety of known home electronics applications. For example, the remote control unit may include memory, "MEM" and recall memory "RCL" buttons 55 and 57 respectively. When the user first determines an optimal or preferred comfort level, he or she may enter that level into a memory within the system by simply selecting the "MEM" button. Subsequently, the stored memory may be recalled using the "RCL" button in a manner similar to other electronic control devices. Such an operation will be understood to persons skilled in the art.

Figure 5:
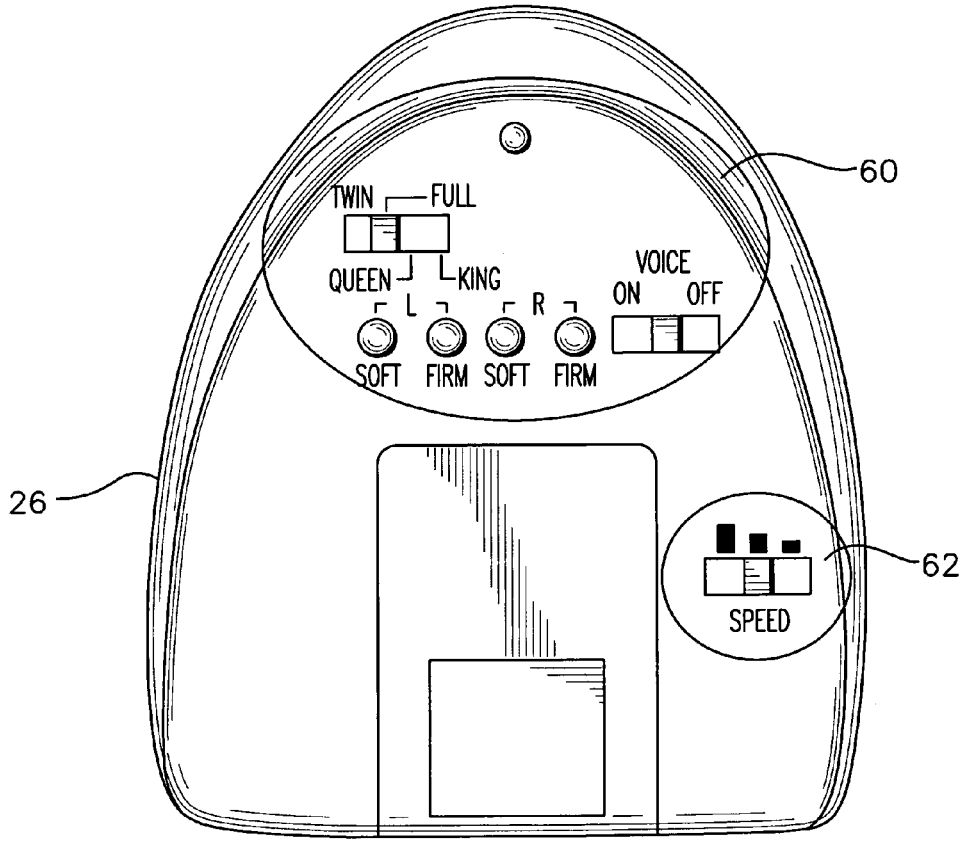
FIG. 5 is a bottom view of the charger base particularly illustrating the manual control panel for operating the pump unit independently of the remote control.

As shown in FIG. 5, base control unit 26 may carry a manually accessed control panel 60 thereon, which allows the programmable controller to be operated manually when remote control unit 28 is lost or otherwise unavailable. In particular, panel 60 includes various buttons and switches that are operated to control the softness and firmness of the left-hand and right hand sides of the support respectively. A switch is also provided to control voice activation of the base control unit. An additional switch 62 may be employed to control the speed at which the vacuum pump operates.

A critical aspect of this invention is the use of a feedback system to monitor the level of pressure, firmness/softness and/or contour in foam support apparatus 12. In particular, pressure vacuum sensors 44, 45, shown in FIG. 2, are incorporated into unit U and communicably joined to respective core chambers in sides 12*a*, 12*b* of support 12 through tubes 20, 22 (such as in the manner described below in connection with FIG. 6). Sensors 44, 45 directly and dynamically detect the internal pressure or vacuum within the respective sides of the foam core of support 12 and are not simply reflecting a desired or target pressure set for the vacuum pump. This significantly distinguishes the present system from previous positive pressure air mattresses, which do not dynamically measure pressure of any type within the inflated support, but rather simply program targeted positive pressure for the pump. The present system uniquely measures vacuum pressure in a foam core in real time. Sensors 44, 45 generate respective feedback signals S, which are indicative of the sensed real time vacuum pressure in a respective side of support 12. Signals S are directed back through CPU 29 to microprocessor 27 of base control 26. This feedback information can then be transmitted as a feedback signal 32 to remote controller 28. The sensed feedback signal may then be displayed on the visual display 38 of remote controller 28. It may also be indicated audibly by an appropriate speaker unit in the remote controller.

Feedback and subsequent adjustment by the user of the pressure/firmness/support level may be required because the support will typically change its pertinent levels when the user engages his or her body against the support. For example, when a reclining body presses against the support, the vacuum within the foam core is reduced and positive pressure increases. Conversely, when the user disengages the foam core, the positive pressure is reduced and the vacuum increases. A selected firmness/pressure level is especially apt to change when the user first reclines against the core. In such cases, the feedback allows the user to visually and/or audibly monitor this change and to make the necessary adjustments.

Initially, system 10 automatically calibrates itself to provide an optimal level of support based upon an individual user's weight and body type. Before the user engages the foam support and actives the system, the hermetically sealed support is at or slightly above atmospheric pressure. The user engages the support typically by lying on a selected side of the support. Calibration is then performed for the hermetically sealed chamber on the selected side. In particular, the user presses any button on remote control unit 28 to activate the system. In automatic or "demo" mode, the system commences calibration automatically without a button being pressed. Motor 19 is started and one of the valves 16, 18 corresponding to the selected side of the support is opened. Motor 19 operates vacuum 14 for a predetermined amount of time programmed into the CPU 29. After that predetermined period of time, motor 19 is stopped and the open valve closes. A vacuum pressure reading is taken by the corresponding pressure sensor 45, 46. CPU 29 then directs the relevant valve 16, 18 to re-open. As a result, air is transmitted through the communicably connected conduit 20, 22 to the foam core. The foam is thereby allowed to reform to atmospheric pressure. An algorithm contained in the CPU utilizes the pressure measurement and the time required for foam reformation to determine an optimal support level for that user on his or her selected side of the foam support. Pump 14 is thereby calibrated for that user.

Subsequently, when the aforementioned user engages support 12, he or she utilizes an appropriate selector button or switch 51 (FIG. 4) on remote controller 28 to access the appropriate side of support 12. The user then presses the "soft" button (i.e. the down arrow 33 in FIG. 4). This causes the respective valve to open and starts the motor 19, FIG. 2, to draw a vacuum on the selected side of the foam core. When the previously calibrated optimal support level is reached, the pump is programmed to automatically stop. The system then advises the user audibly and/or visually that the optimal support level has been achieved for that user. The user is also advised (audibly and/or visually) to press "soft" (down arrow) or "firm" (up arrow) to customize the support level. In this manner, the user is able to make the support firmer or softer as desired.

The system is programmed to calibrate the pump for a particular user such that the firmness is reduced at least forty percent from the original firmness of the support at atmospheric pressure. This provides the user with a medium soft firmness level, which is medically recommended for sleeping. As previously indicated, this firmness level may be custom adjusted by utilizing the appropriate keys 33 on remote control 28.

Figure 6:
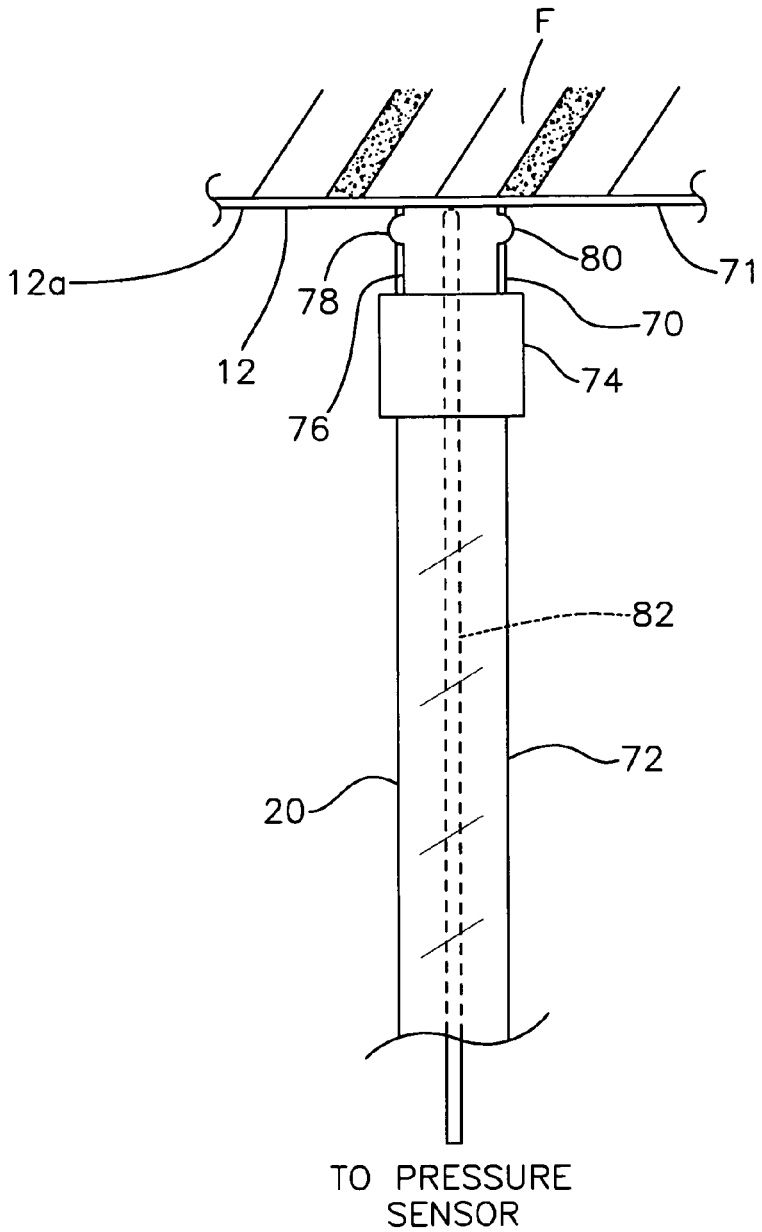
FIG. 6 is a fragmentary view of a preferred vacuum hose having an interior pressure transmitting tube, which interconnects the foam core and a respective pressure sensor, for measuring the vacuum pressure within a respective side of the foam core.

As shown in FIG. 6, representative conduit 20 is communicably connected to the chamber enclosing foam core F on side 12*a* of support 12 through a tubular port 70 that extends through the outer shell 71 of support 12. More particularly, conduit 20 includes an elongate hose 72 that terminates in a collar 74 and a reduced diameter fitting 76 extending from collar 74 and in communication with the hose. Fitting 76 fits within tubular collar 70 and includes opposing ears 78, 80 that fit within corresponding locking holes of tubular fitting 70 to secure conduit 20 communicably to support 12.

A small diameter pressure tube 82 extends through conduit 20 from a distal end within the hermetically sealed support 12 to an opposing proximal end, which is secured to a respective pressure sensor (i.e. pressure sensor 44, FIG. 2) within vacuum unit U. It should be understood that the other conduit 22 communicably connected to the right hand side of support 10 (see FIG. 1) is constructed in an analogous manner and likewise includes an internal pressure tube that is communicably interconnected between the chamber in the right hand side of the support and the other pressure sensor 45 (FIG. 2). The respective pressure sensing tubes 82 directly detect the vacuum pressure within respective sides of support 12 and transmit that information to respective pressure sensors 44, 45. These sensors then relay the sensed vacuum pressure to the CPU of the vacuum unit, which responds by controlling operation of the vacuum pump and accessory instruments in a manner described more fully below. This construction clearly differentiates the present device from previous air mattress units wherein pressure is controlled in accordance with programmed parameters within a positive pressure pump and not in response to vacuum pressure measured directly within a foam support.

Figure 7:
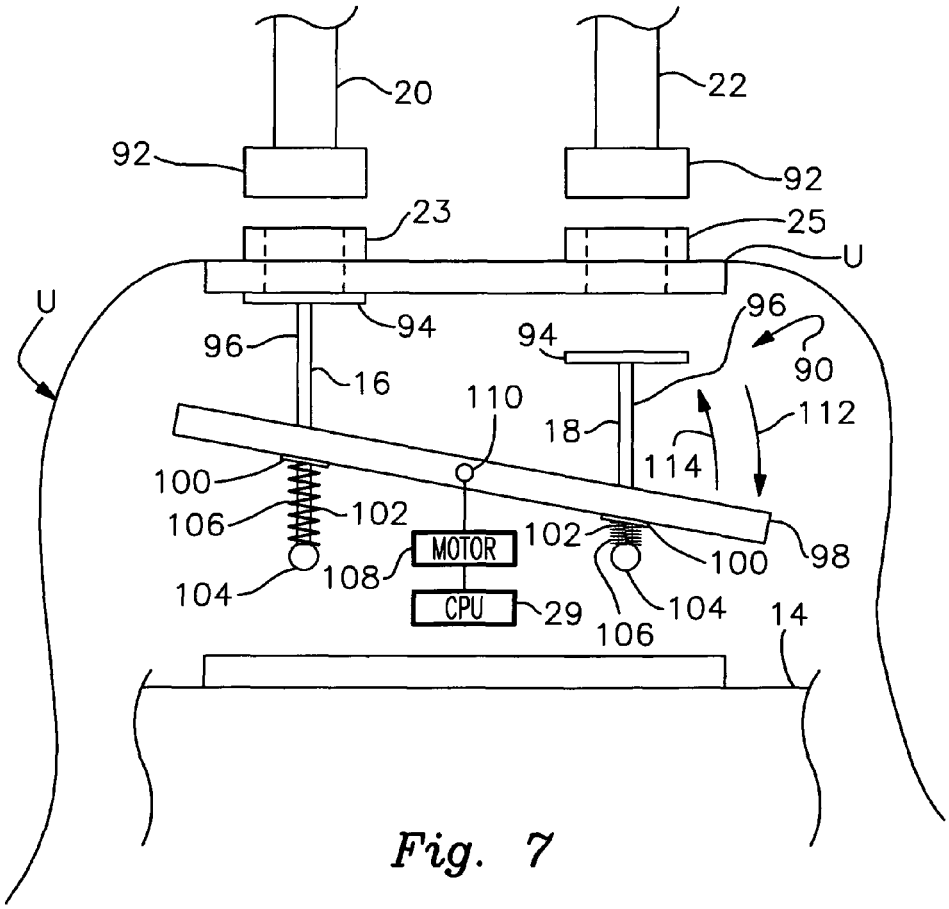
FIG. 7 is a fragmentary and partially schematic view of a preferred dual valve mechanism used in this system.

FIG. 7 depicts a dual valve assembly 90 mounted within vacuum unit U. The valve assembly 90 is operated in accordance with instructions from CPU 29 to selectively adjust the vacuum pressure within respective sides of the foam support. As described above, the adjoining sides of the support are interconnected to vacuum unit U through respective conduits 20 and 22. Conduit 20 is communicably connected to unit U through cylindrical port 23 and conduit 22 is similarly joined to vacuum unit U through similar port 25. Each conduit includes a proximal fitting 92, which is selectively secured, threadably or otherwise, to complementary structure of a respective vacuum intake port 23, 25.

Valve assembly 90 is mounted within vacuum unit U between the intake ports 23 and 25 and vacuum pump 14. Valve assembly 90 includes a pair of piston valves 16 and 18. Each valve 16,18 includes a respective valve head 94 that is selectively opened and closed relative to a complementary valve seat in a corresponding one of ports 23 and 25. Each piston valve further includes an elongate rod 96 that extends rearwardly from the head and through an aligned opening in a valve actuator bar 98. The rearward end of each piston rod 96 carries an actuator collar 100 that is directly engaged by actuator bar 98. A bore, not shown, is formed longitudinally through each piston rod 96 and is aligned with a central hole in the collar 100 attached to that rod. The bore and aligned hole in collar 100 receive a respective piston mounting shaft 102 that is itself attached and extends from a respective shaft support 104 mounted fixedly within the body of vacuum unit U. A helical spring 106 is wound about each piston mounting shaft 102 between support 104 and collar 100.

In operation, CPU 29 is programmed, in a manner described more fully below, to control the operation of valve assembly 90 such that as vacuum 14 is operated, vacuum pressure may be selectively adjusted within respective sides of the foam support to which the vacuum unit is connected. By the same token, a selected one of the valves 16, 18 may be opened with the vacuum pump turned off to allow air to return to the foam support and thereby increase the pressure within a corresponding side of the support, which re-forms the support.

To open right hand valve 18, as shown in FIG. 7, CPU directs an attached motor 108 to rotate actuator 98 about a central mounting pivot 110 in the direction of arrow 112. The right hand side of actuator bar 98 bears against right hand collar 100 to draw head 94 of valve 18 rearwardly. This separates valve 18 from its corresponding valve seat and opens the valve so that pneumatic communication is established between the interior vacuum unit U and the right hand side 12*b* of the foam support. At the same time, the right hand helical spring 102 disposed between collar 100 and support 104 is compressed, whereas the other, left hand spring 106 associated with valve 16 remains extended to hold valve 16 in a closed condition relative to port 23. In accordance with the programmed operation of the vacuum unit, vacuum pump 14 may be operated to draw air out of the foam support through attached conduit 22. Alternatively, vacuum pump 14 may be deactivated to allow air to be drawn or sucked back into the right hand side of the foam support by the foam core. The IFD and density of the right hand side of the foam core is thereby adjusted in the manner disclosed herein and further described in the references cited above.

When the program calls for closing valve 18 to maintain a selected pressure in side 12*b* of support 12, this is simply, quickly and reliably accomplished. CPU 29 sends a corresponding signal to motor 108, which in turn directs actuator bar 98 to pivot in a counterclockwise direction about pivot pin 110, i.e. in the direction of arrow 114. The right hand spring 106 of valve 18 bears against collar 100 and urges head 94 of valve 18 to seat against the valve seat associated with port 25. This securely closes valve 18. The actuator bar may be pivoted in the direction of arrow 114 by an amount that seats and closes both valves, or alternatively by a greater amount that opens left hand valve 16.

Valve 16 is controlled in an analogous manner to selectively open or close port 23 as desired. In particular, CPU 29 sends program signals to motor 108, which selectively rotates actuator bar 98 in a counterclockwise direction against the left hand spring 106. The actuator bar bears against left hand collar 100 to pull valve 16 into an open condition for adjusting the pressure in the left hand side of the foam support. The left hand valve 16 may then be closed as needed in a fashion analogous to that previously described.

The valve assembly thereby operates as programmed to either simultaneously close both valves 16 and 18 or selectively open one of the valves while retaining the other valve in a closed condition. Both valves are simultaneously closed in order to maintain selected pressures within respective sides of the foam support. A selected valve is opened to adjust the pressure and resulting IFD and foam density within a corresponding side of the support in the manner described herein.

Because the vacuum unit U does not use conventional solenoid valves, which open and close with electric current, the valve assembly avoids making a loud clunk or noise when on or both of valves 16 and 18 close. Instead, valve assembly 90 employs springs 106 that achieve a much quieter closing operation.

CPU 29 is provided with intelligent software that calibrates the vacuum pump unit to determine and automatically provide a particular user with an optimal level or support as previously described. The intelligent software also enables the unit to automatically perform predetermined functions in response to sensed changes in vacuum pressure within the foam support. Flow charts depicting the logic used in this intelligent software are presented in FIGS. 8 and 9.

Figure 8:
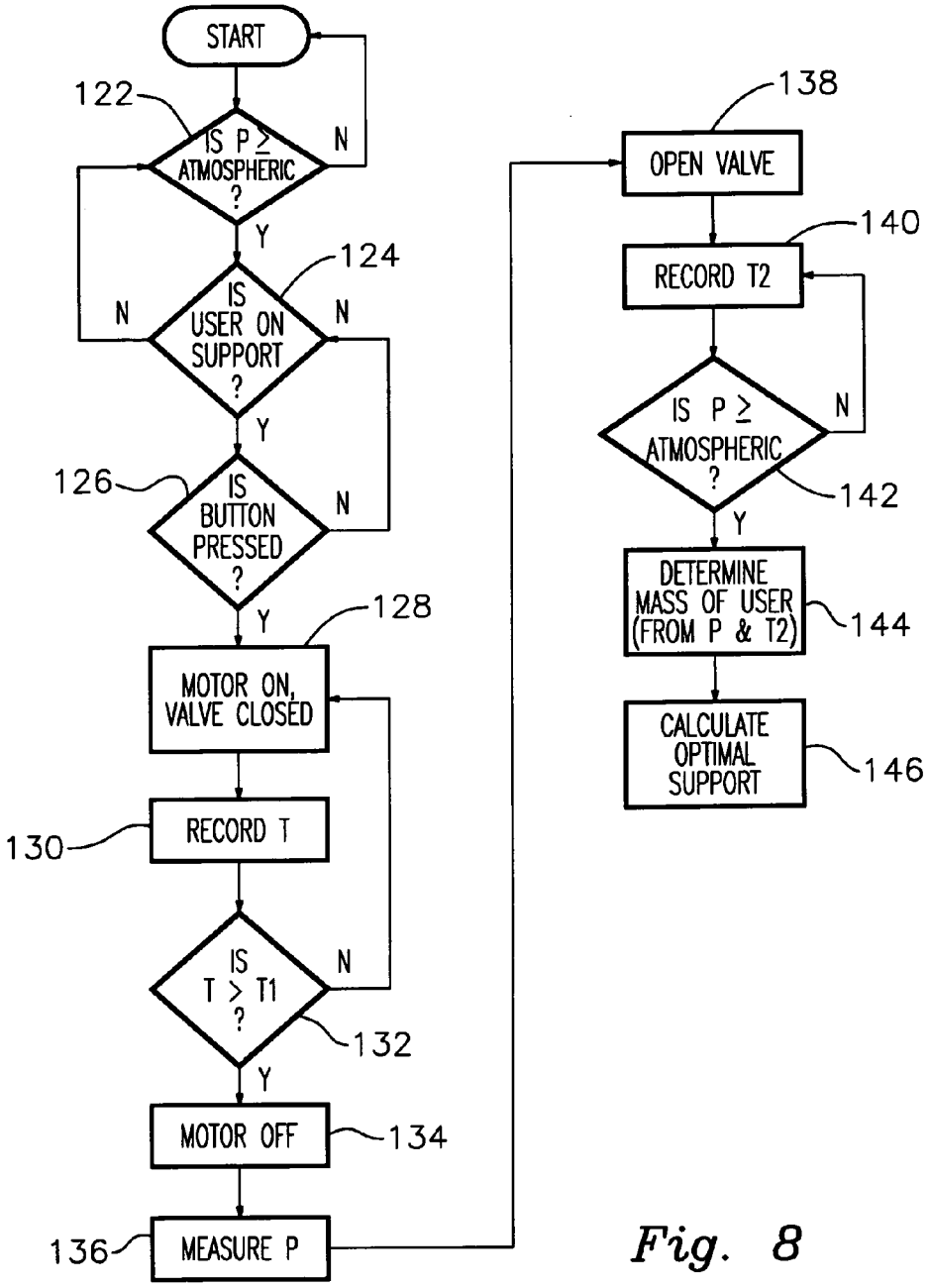
FIG. 8 is a flow chart of a preferred program for calibrating the pump to provide an optimal support level.

In particular, FIG. 8 illustrates the program for calibrating the vacuum unit, in the manner previously described, to provide optimal user support. The calibration software first inquires whether the pressure sensed by a selected sensor 44, 45 (corresponding to the side of the bed/support to be calibrated) is at or above atmospheric pressure, which indicates that the associated chamber of the foam support is at maximum inflation and firmness. If it is, and if queries 124 and 126, respectively asking whether the user is engaged with that side of the support and whether any button of the remote is engaged, are also answered affirmatively, calibration commences. Vacuum motor 19 is turned on and the associated valve 16, 18 is closed, step 128. A timer records the duration T1 of this operation, step 130. When a predetermined time T1 is exceeded, query 132, the vacuum motor is turned off, step 134, and the pressure within the foam support is measured by the corresponding sensor, step 136. The previously closed, corresponding valve is then opened, step 138, and a second timing operation is commenced, step 140. The foam re-forms and the program asks whether or not the sensed pressure within the relevant side of the foam support has returned to atmospheric pressure, query 142. When that level of pressure has been achieved, the measured time T2 and the previously determined pressure derived in step 136 are utilized to determine the mass of the particular user for whom the support is being calibrated, step 144. An algorithm is then employed to calculate an optimal support level for that user, step 146. That calibrated support level is then stored within a random access memory of the CPU for use by the user. In particular, the user then presses the "SOFT" (down arrow) button on the remote controller to re-activate the vacuum and close the related valve. Air is withdrawn from the user's selected side of the foam support until the previously determined optimal support level is reached. The motor stops, the valve closes and an audible reminder advises the user that "Optimal Support Found, Press SOFT or FIRM to Customize". The user can then operate the relevant buttons to make the support firmer or softer as desired. A display on the remote controller includes numerals (e.g. 1-10) reflecting corresponding levels of IFD, firmness and support. Typically, the optimal level of support that has been calibrated/calculated for the user is associated with one of these numeric levels. As previously indicated, a preferred level of optimal support is a level of approximately 40% of the firmness of the foam support at atmospheric pressure. This is a level that is recommended by physicians to provide a medium to soft sleep surface. At this level, the foam contours to the user's body parts and undesirable pressure points at respective areas of contact with the body are reduced, if not fully alleviated.

Figure 9:
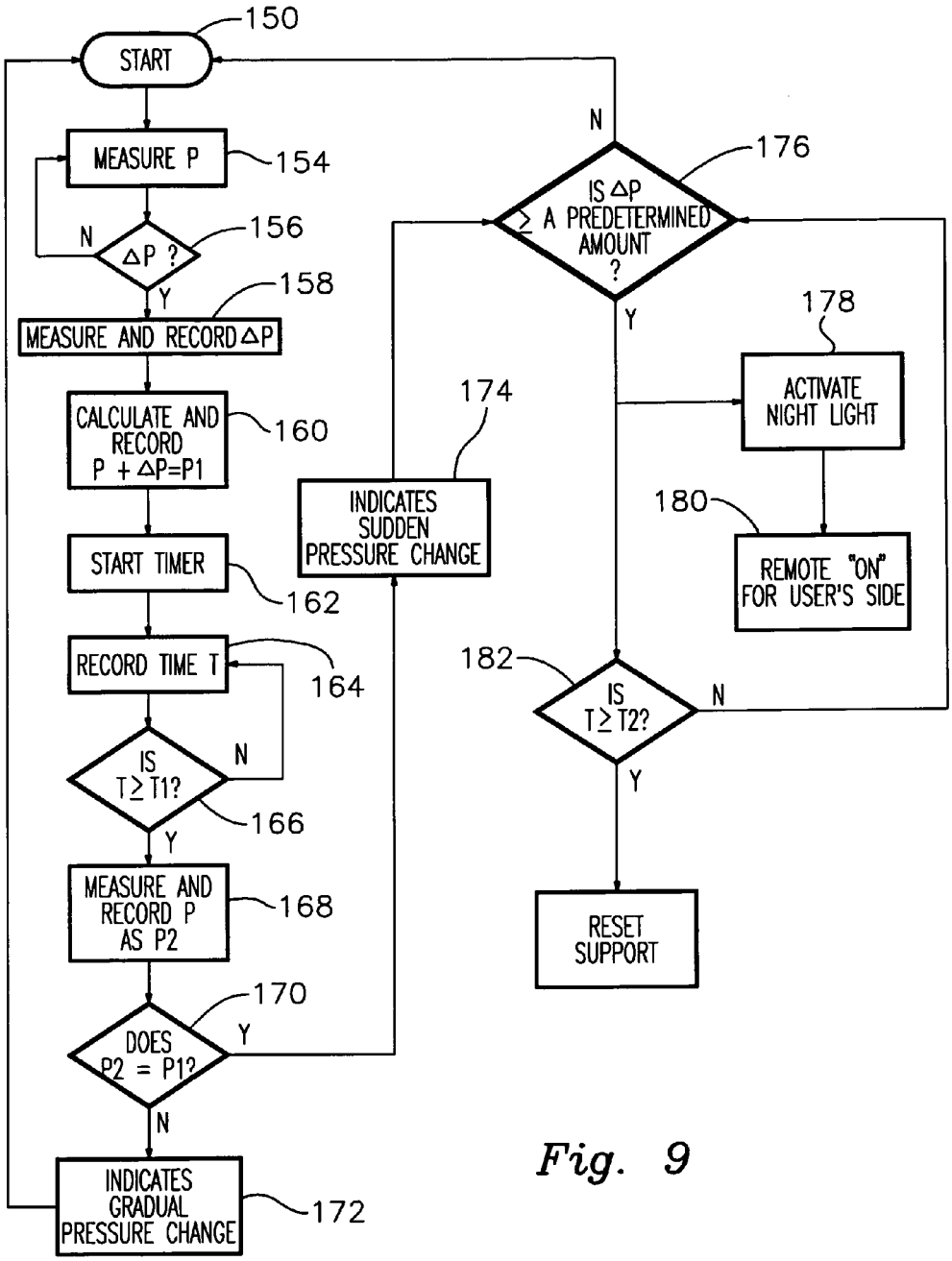
FIG. 9 is a flow chart of an "intelligent" program used to operate the pump unit automatically.

FIG. 9 illustrates the operation of the intelligent software when the vacuum unit U is operated in an automatic mode. The automatic mode is typically activated, step 150, by engaging a button 154, FIG. 4, on remote control unit 28. If the automatic mode is not selected, manual operation may be performed using the remote control unit. When the automatic mode is in operation, the program directs the respective sensors to measure pressure changes in respective sides of the foam support, step 154. When a predetermined pressure change is sensed in one side of the support, the automatic mode controls operation for that side in the manner described below. In particular, the vacuum operates in conjunction with a valve, sensor, hose and chamber associated with one side of the foam support. While the user engaged on the support remains relatively still (e.g. while sleeping) the sensed pressure on his or her side of the support should change minimally, if at all from the previously set level. That initial pressure level is selected in one of various ways. For example, when the user first engages the support, he or she may manually operate the remote control to provide a custom level of support. Alternatively, the user may initially calibrate the pump to arrive at an optimal support level, as previously described, and the user may select and utilize that calibrated level.

Returning to FIG. 9, the program monitors the pressure, step 154, detected by the related pressure sensor. The program asks if there has been a change in the measured pressure, ΔP, due to movement by the user and/or disengagement of the user from the support, query 156. The sensed change in pressure ΔP is measured and recorded, step 158 and a changed pressure value P1 is calculated and recorded according to the formula P+ΔP=P1, step 160. At the same time, a timer commences operation, step 162 and a time T is recorded, step 164. The program inquires whether time T is greater than or equal to a predetermined duration T1, step 166. This duration is selected to correspond with the time typically required for sudden pressure changes to occur due to either bodily movement by the user or disengagement of the user from the support.

When T exceeds duration T1, the CPU again measures pressure P and records that pressure as P2, step 168. The program then asks whether pressure P2 is equal to the previously calculated changed pressure P1. If the answer to this query is "no", this indicates that the pressure is continuing to change after the "sudden movement" time duration T1, step 172. This typically reflects that the pressure within the foam core is changing gradually rather than suddenly, which usually indicates that the foam core is in the process of being angularly adjusted. Accordingly, the program returns to the start 150 of the automatic mode program and continue monitoring pressure.

Alternatively, if the pressure measurements P2 and P1 are equal, this indicates that the pressure change ΔP is maintained for at least the duration T predetermined to correspond with sudden movement by the user, step 174. The program next asks if the previously measure ΔP is greater than or equal to a predetermined amount, query 176. This predetermined amount is selected to differentiate between pressure changes resulting from tossing, turning or other slight movement by the user while sleeping or otherwise engaging the support, and total disengagement of the support by the user, which occurs when the user gets up and leaves the mattress or other support. If pressure change ΔP is less than the predetermined value (a "NO" answer to query 176) the program again returns to the start 150 of the automatic mode. This reflects that the user is tossing, rolling or otherwise moving to generate only slight pressure changes in the foam core. Accordingly, there is no need to automatically adjust the system or its accessories.

On the other hand, if query 176 is answered affirmatively, the pressure change is sufficient to indicate that the user has totally disengaged the support. This activates a night light, step 178, which is located adjacent to the user (such as on the nightstand) and which is operably connected to the system by either hardwired or wireless means. The predetermined pressure change also causes the remote control unit to be activated or turned "ON" for the user's side of the support, step 180. The user can then operate the remote control as desired.

When the predetermined pressure level ΔP is detected, the program also asks if the timer, which was activated when the pressure change was initially sensed, has measured a predetermined time duration T2, query 182. That time is typically set to correlate with a duration indicating that the user has disengaged with a mattress in the morning or for another extended period (e.g. T2 is approximately 30 minutes or longer). In this case, the program confirms that the pump is turned off and the relevant valve is opened so that the foam support resets to atmospheric pressure. In this case, the foam support re-inflates and returns to a maximum firm condition. The relevant side of foam support is re-formed and the bed is essentially returned to a "made" condition.

Alternatively, if the elapsed time is less than T2 and query 158 reveals that ΔP is less than P1, this indicates that the user has re-engaged the support. Such a scenario typically occurs, for example, if the user briefly disengages a mattress in order to use the bathroom, retrieve a glass of water or otherwise for brief intervals during the night. The automatic mode program then returns to monitoring the foam core for subsequent pressure variations.

The vacuum pump unit of this invention may be programmed with other various features that improve the use of the system. For example, when the user disengages the support and a change of pressure greater than P1 is detected, an "OUT OF BED" icon may be displayed on screen 38. During such periods, the remote controller may be programmed so that engaging any button while the support is disengaged, will cause the support to re-inflate into a maximum firm condition. This feature serves a couple of purposes. There is no benefit or advantage to adjusting the support when a user or other load is not engaged with the support. Moreover, this feature allows the bed to automatically re-inflate if small children are playing with the remote without engaging the support.

Pump motor 19, FIG. 2, preferably employs a variable speed. As the motor operates the vacuum to draw more air out of the foam support, the foam core exerts a greater tendency to re-inflate and recall air back into the cells of the foam core. Accordingly, motor 19 is instructed to increase in speed as the foam is deflated and made softer. This enables the adjustment of the foam to proceed consistently throughout operation of the vacuum pump. A progressive increase in speed also results in a progressive or gradual increase in the noise of the motor, which is typically less disturbing to the user.

The program provides the remote controller with voice feedback and instructions to the user. The voice feedback may advise the user, for example, that the pump is being calibrated, that an optimal support level is reached or that an excess contour is sensed in the foam support. The pump unit software may also instruct the motor to stop operating if such an excess contour is detected for a particular user.

As previously indicated, the voice feedback can be programmed to advise the user when the calibrated maximum comfort level has been reached. It can also advise the user when the support is in a "FIRM" or "SOFT" condition relative to the calibrated level of optimal support. The system can also advise the user when the support is excessively firm or soft and can instruct the user to adjust the support accordingly. A one-touch button 59, FIG. 4, may be engaged to automatically reset the support to a maximum firm condition, e.g. approximately atmospheric pressure. If the "MEMORY RECALL" button is pressed but no level of support was previously entered into the memory, an "ERROR" message is displayed. A voice command may also indicate that error.

As previously indicated, if the CPU detects a predetermined pressure change F on the user's side of the support (which indicates that the user has disengaged the support) the remote control unit is automatically switched to control operation of that user's side of the support. At the same time, the voice feedback and messages are disabled so that a person sleeping on the other side of the support is not disturbed. The remote controller may also include a toggle switch 51 that allows a user to manually switch operation of the control unit so that unit 28 controls the other side of the support in the manner previously described.

The firmness control buttons are "childproof". The unit's software requires that the "SOFT" button be pressed and held in order to operate the motor and activate the vacuum. In addition, an "ON/OFF" switch for activating and deactivating the remote may be placed on the underside of the remote controller in a location that is difficult for a child to find. The voice controls can be turned on and off by a switch 61 located on the bottom of the base unit 26, FIG. 5. The voice feedback may be selectively provided in a male or female voice and in various languages.

Because the present invention employs small diameter, pressuring sensing tubes 82, pressure is measured effectively and precisely within foam support 12 itself. Even minuscule pressure variations occurring in real time are detected by the sensors. The system is thereby able to reliably determine $\Delta P$ and is able to accurately ascertain whether the user is simply tossing, turning or otherwise moving around the mattress or alternatively is getting out of and back into bed.

Switch 62 on the bottom of the remote control charger 26 may be operated to instruct the motor and vacuum pump to adjust the firmness of the foam support at various speeds. Adjusting at a fast speed (the left hand switch position) allows the user to adjust the support throughout the entire spectrum of firmness levels between FIRM and SOFT most rapidly. Nonetheless, if the adjustment is made too rapidly for a previously calibrated maximum support level, an excess contour or excess vacuum will be measured and, as previously indicated, the motor may be stopped and/or appropriate voice instructions may be generated.

The middle speed adjustment position indicates that modulation of the foam support will be performed at a medium speed. This typically permits adjustment of the support through approximately three-quarters of the full spectrum between FIRM and SOFT. Medium speed adjustment is performed slower than the fast speed adjustment. The right hand position of switch 62 is a "slow" adjustment wherein the firmness level of the support is adjusted throughout approximately half of the full spectrum between FIRM and SOFT and at a speed slower than medium. Typically, in the "slow" position, the pump adjusts the support from FIRM to MEDIUM. Speed settings are particularly useful for different topper materials. A thick topper material such as double gel would typically require a "fast" speed setting. A relatively thin topper material would preferably utilize a slow speed modulation.

System 10 may be used effectively in alternative applications such as recliners and car seats. In a recliner, separate foam supports may be provided in the seat and the back of the recliner. In such versions, separate valves may be provided for selectively removing air from and introducing air into the respective foam supports. In the car seat version of this invention, a relatively small vacuum pump is provided under the seat. In both the recliner and car seat embodiments, a remote control apparatus and pressure feedback are typically omitted. Instead, a manually operated control is connected by appropriate wiring to the pump. The control functions are typically limited to "UP", "DOWN", "RESET" and "MEMORY". Firmness/softness are controlled by operating the buttons in a conventional manner.

In embodiments featuring a remote control unit, various types of audiovisual feedback may be provided for the user through the remote control unit 28. For example, the remote controller may advise the user that the foam support, while bearing a load, is (1) in a state of little or no contour when in a maximum firm condition, (2) in a state of maximum contour when in its softest (lowest pressure) condition and (3) in one of various other incremental contour levels when the support is intermediate its firmest and softest conditions. Typically, the pressure/vacuum range is between 0.80 kpa to −4 kpa.

The system may also employ a wide variety of user voice activated commands as disclosed herein and otherwise, as well as corresponding voice activated software that interprets one or more verbalized commands to provide selected levels of tactile softness, contour, pressure and support for the foam. The voice activated system may also allow the user to direct the base controller to turn off the pump and close the valve to maintain a selected level of vacuum, softness, contour and resulting support within the foam core. Such voice commands may be transmitted through a voice control module (FIG. 3) to microprocessor 27, which is programmed to control operation of the pump as desired.

The system of this invention allows a user to conveniently, precisely and, in certain embodiments, automatically control the level of vacuum and corresponding firmness, contour and support in an adjustable foam mattress or other support apparatus. The versatility and convenience of adjustable foam support devices such as mattresses, pads, mats, seat covers and the like are thereby improved considerably.

From the foregoing it may be seen that the apparatus of this invention provides for a system for controlling and providing feedback of the pressure, firmness and support of an adjustable foam support apparatus. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

Other embodiments will occur to those skilled in the art and are within the following claims:

What is claimed is:

1. An adjustable foam support system comprising:

a resilient, self-inflating, open-cell foam core having incrementally adjustable levels of firmness, which foam core is alternatable between atmospheric pressure in a fully inflated state and a subatmospheric pressure in a partially inflated state;

a hermetically sealed covering that encloses said foam core;

a vacuum pump that is communicably connected with said foam core through said hermetically sealed covering such that said vacuum pump is pneumatically communicable with the open cells of said foam core;

a valve interconnected between said foam core and said vacuum pump for alternately opening to permit and closing to block the passage of air into and out of the open cells of said foam core respectively;

a manually operable control system that generates selected control signals, each said control signal representative of a respective said level of firmness of said foam core;

a vacuum pressure sensor in pneumatic communication with said foam core for dynamically sensing subatmospheric pressure changes and corresponding firmness level changes in said open cell foam core in real time and for generating feedback signals indicative thereof;

a CPU responsive to said selected control signals and said feedback signals for operating said pump and said valve to maintain a selected said level of firmness within said foam core; said CPU opening said valve and activating said vacuum pump such that air is suctioned from the open cells of said foam core to partially deflate said foam core and reduce the firmness of the foam core; said CPU opening said valve and deactivating said vacuum pump such that said foam core self-inflates to increase the firmness of the foam core and adjust the subatmospheric pressure within the open cells of the foam core to not greater than atmospheric pressure; said CPU closing said valve and deactivating said vacuum pump with said foam core in a selected partially inflated state for maintaining a corresponding subatmospheric pressure and firmness level within said foam core, which provides said foam core with a viscoelastic or latex foam feel; and an indicator device in electronic communication with said vacuum pressure sensor and said CPU and responsive to said control and feedback signals for indicating the sensed firmness of said foam core;

said CPU including intelligent software responsive to said feedback signals and a predetermined real time change of vacuum pressure being sensed within said foam core when said vacuum pump is deactivated and said valve is closed for identifying the nature of the real time change of vacuum pressure and automatically initiating at least one responsive action from the group consisting of opening said valve, activating a night light, activating said control system and providing feedback messages through said indicator device relating to the sensed change of vacuum pressure within said foam core.

2. The system of claim 1 in which said control system selectively generates and transmits a minimum control signal representative of a minimal pneumatic pressure and corresponding firmness in said core, a maximum control signal representative of a maximum pneumatic pressure and corresponding firmness in said core, and at least one intermediate control signal representative of a pneumatic pressure intermediate said minimal and maximum pneumatic pressures and a firmness intermediate said minimum and maximum firmnesses.

3. The system of claim 1 in which said control system includes a remote control unit for generating the selected control signals and a base control unit responsive to said remote control unit for operating said pump and said valve in accordance with the selected control signals.

4. The system of claim 1 in which said indicator device provides at least one of a visual display and an audio report of the sensed firmness and contour of said foam core.

5. The system of claim 3 in which said remote control unit and said indicator device are integrated into a transceiver unit having a transmitter for directing said control signals to said base control unit and a receiver for directing said feedback signals from readings taken from said pressure sensor to said indicator device.

6. The system of claim 1 in which said indicator device indicates a change in the pneumatic pressure sensed in said core independent of the operation of said pump and said valve.

7. The system of claim 1 in which said controller is programmable for providing selected control signals that operate said pump and said valve to produce respective predetermined levels of firmness in said core.

8. The system of claim 3 in which said remote control unit includes at least one of a touch pad and touch screen for generating a selected control signal.

9. The system of claim 1 in which said intelligent software is responsive to said pressure sensor for detecting a predetermined decrease in pressure in said core and for directing said valve to open with said vacuum pump off to inflate said core when said predetermined pressure decrease is maintained for a predetermined time.

10. The system of claim 9 in which said indicator devices includes an audible indicator responsive to said intelligent software for indicating when the sensed changes of pressure are not within said predetermined parameters.

11. The system of claim 1 in which said intelligent software is responsive to said sensor for activating a night light when said sensor detects a predetermined change in vacuum pressure for a predetermined time within said core section.

12. The system of claim 1 in which said intelligent software is responsive to said sensor to control the firmness level of said core section when said pressure sensor detects a predetermined change in vacuum pressure for a predetermined time within said core section.

13. The system of claim 1 in which said vacuum pump is communicably connected to said hermetically sealed foam core by a hose and wherein a pressure sensing tube extends longitudinally through said hose between said hermetically sealed foam core and said pressure sensor whereby the pressure within said foam core is transmitted through said pressure sensing tube and measured directly and dynamically by said pressure sensor.

14. The system of claim 1 in which said intelligent software differentiates between sudden, progressive, intermittent, large and small changes in pressure within said core to indicate respective types of external forces applied to said core.

15. The system of claim 1 in which said control system includes voice recognition software for responding to verbal commands to direct said pump to adjust the level of firmness in said core.

16. The system of claim 1 in which said CPU is responsive selectively to said control signals for manually adjusting the selected level of firmness within said foam core and alternatively to said feedback signals for automatically adjusting the selected level of firmness in said foam core.

17. The system of claim 1 further including a variable speed motor responsive to said CPU for operating at progressively greater speeds so that said vacuum pump draws an increased suction of said foam core as said foam core is deflected and made softer to counterbalance the resilient restoring force of said core.

18. An adjustable foam support system comprising:

a resilient, self-inflating, open-cell foam core having incrementally adjustable levels of firmness, which foam core is alternatable between atmospheric pressure in a fully inflated state and a subatmospheric pressure in a partially inflated state;

a hermetically sealed covering that encloses said foam core;

a vacuum pump that is communicably connected with said foam core through said hermetically sealed covering such that said vacuum pump is pneumatically communicable with the open cells of said foam core;

a valve interconnected between said foam core and said vacuum pump for alternately opening to permit and closing to block the passage of air into and out of the open cells of said foam core respectively;

a manually operable control system that generates selected control signals, each said control signal representative of a respective said level of firmness of said foam core;

a vacuum pressure sensor in pneumatic communication with said foam core for dynamically sensing subatmospheric pressure changes and corresponding firmness level changes in said open cell foam core in real time and for generating feedback signals indicative thereof;

a CPU responsive to said selected control signals and said feedback signals for operating said pump and said valve to maintain a selected said level of firmness within said foam core; said CPU opening said valve and activating said vacuum pump such that air is suctioned from the open cells of said foam core to partially deflate said foam core and reduce the firmness of the foam core; said CPU opening said valve and deactivating said vacuum pump such that said foam core self-inflates to increase the firmness of the foam core and adjust the subatmospheric pressure within the open cells of the foam core to not greater than atmospheric pressure; said CPU closing said valve and deactivating said vacuum pump with said foam core in a selected partially inflated state for maintaining a corresponding subatmospheric pressure and firmness level within said foam core, which provides said foam core with a viscoelastic or latex foam feel; and an indicator device in electronic communication with said vacuum pressure sensor and said CPU and responsive to said control and feedback signals for indicating the sensed firmness of said foam core;

said CPU including intelligent software responsive to said feedback signals and predetermined real time variation of vacuum pressure measured in said foam core when said vacuum pump is deactivated for identifying the nature of said change in vacuum pressure in said foam core and instructing said foam support system to automatically initiate a predetermined action in response to said sensed pressure change in accordance with programmed parameters.

19. The system of claim 18 in which said CPU is responsive selectively to said control signals for manually adjusting the selected level of firmness within said foam core and alternatively to said feedback signals for automatically adjusting the selected level of firmness in said foam core.

20. The system of claim 18 further including a variable speed motor responsive to said CPU for operating at progressively greater speeds so that said vacuum pump draws an increased suction of said foam core as said foam core is deflected and made softer to counterbalance the resilient restoring force of said core.

21. An adjustable foam support system comprising:

a resilient, self-inflating, open-cell foam core having incrementally adjustable levels of firmness, which foam core is alternatable between atmospheric pressure in a fully inflated state and a subatmospheric pressure in a partially inflated state;

a hermetically sealed covering that encloses said foam core;

a vacuum pump that is communicably connected with said foam core through said hermetically sealed covering such that said vacuum pump is pneumatically communicable with the open cells of said foam core;

a valve interconnected between said foam core and said vacuum pump for alternately opening to permit and closing to block the passage of air into and out of the open cells of said foam core respectively;

a manually operable control system that generates selected control signals, each said control signal representative of a respective said level of firmness of said foam core;

a vacuum pressure sensor in pneumatic communication with said foam core for dynamically sensing subatmospheric pressures and corresponding firmness levels in said open cell foam core in real time and for generating feedback signals indicative thereof;

a CPU responsive to said selected control signals and said feedback signals for operating said pump and said valve to maintain a selected said level of firmness within said foam core; said CPU opening said valve and activating said vacuum pump such that air is suctioned from the open cells of said foam core to partially deflate said foam core and reduce the firmness of the foam core; said CPU opening said valve and deactivating said vacuum pump such that said foam core self-inflates to increase the firmness of the foam core and adjust the subatmospheric pressure within the open cells of the foam core to not greater than atmospheric pressure; said CPU closing said valve and deactivating said vacuum pump with said foam core in a selected partially inflated state for maintaining a corresponding subatmospheric pressure and firmness level within said foam core, which provides said foam core with a viscoelastic or latex foam feel; and an indicator device in electronic communication with said vacuum pressure sensor and said CPU and responsive to said feedback signals for indicating the sensed firmness of said foam core;

said CPU being programmed to instruct said pump and said valve to automatically adjust the vacuum pressure level within said foam core in accordance with predetermined parameters when a predetermined change in the vacuum pressure level sensed in said core is maintained for a predetermined duration with said pump in a deactivated condition.

22. The system of claim 21 in which said CPU is responsive selectively to said control signals for manually maintaining the selected level of firmness within said foam core and alternatively to said feedback signals for automatically maintaining the selected level of firmness in said foam core.

23. The system of claim 21 further including a variable speed motor responsive to said CPU for operating at progressively greater speeds so that said vacuum pump draws an increased suction of said foam core as said foam core is deflected and made softer to counterbalance the resilient restoring force of said core.

* * * * *